US009181692B1

(12) United States Patent
Callaway et al.

(10) Patent No.: US 9,181,692 B1
(45) Date of Patent: Nov. 10, 2015

(54) COVERING SYSTEM FOR A BUILDING SUBSTRATE

(71) Applicants: Scott Callaway, Belle Vernon, PA (US); Richard Watkins, Latrobe, PA (US); Kenneth Flasik, Adamsburg, PA (US); Douglas Ott, Mineral Point, PA (US)

(72) Inventors: Scott Callaway, Belle Vernon, PA (US); Richard Watkins, Latrobe, PA (US); Kenneth Flasik, Adamsburg, PA (US); Douglas Ott, Mineral Point, PA (US)

(73) Assignee: Overly Manufacturing Co., Greensburg, PA (US)

( * ) Notice: Subject to any disclaimer, the term of this patent is extended or adjusted under 35 U.S.C. 154(b) by 0 days.

(21) Appl. No.: 14/322,318

(22) Filed: Jul. 2, 2014

(51) Int. Cl.

| | |
|---|---|
| ***E04B 1/64*** | (2006.01) |
| ***E04B 1/68*** | (2006.01) |
| ***E04F 13/24*** | (2006.01) |
| ***E04F 15/02*** | (2006.01) |
| ***E04D 1/28*** | (2006.01) |
| ***E04D 1/34*** | (2006.01) |

(52) U.S. Cl.
CPC ..... *E04B 1/64* (2013.01); *E04B 1/6812* (2013.01); *E04D 1/28* (2013.01); *E04D 1/34* (2013.01); *E04F 13/24* (2013.01); *E04F 15/02044* (2013.01)

(58) Field of Classification Search
CPC .... E04B 1/64; E04B 1/6812; E04F 14/02044; E04F 13/24; E04D 1/34; E04D 1/28
See application file for complete search history.

(56) References Cited

U.S. PATENT DOCUMENTS

| | | | | |
|---|---|---|---|---|
| 1,610,247 | A * | 12/1926 | Bonsall | B61D 17/12 52/461 |
| 1,876,597 | A * | 9/1932 | Bennett | E04D 1/18 52/520 |
| 2,078,620 | A * | 4/1937 | Venzie | E04B 2/7854 52/242 |
| 2,219,714 | A * | 10/1940 | Sperry | E04F 13/0814 24/326 |
| 2,747,703 | A | 5/1956 | Broberg | |
| 2,822,898 | A * | 2/1958 | Richards | E04B 2/7448 52/281 |
| 2,889,017 | A * | 6/1959 | Eckel | E04B 1/86 52/467 |
| 3,066,773 | A * | 12/1962 | Raidel | E04D 3/366 29/520 |
| 3,080,021 | A | 3/1963 | Muir | |

(Continued)

FOREIGN PATENT DOCUMENTS

| | | | | |
|---|---|---|---|---|
| DE | 19901418 A1 * | 7/2000 | | E04B 2/965 |
| DE | 202009013261 U1 * | 3/2011 | | E04B 1/6812 |
| WO | WO 9317196 A1 * | 9/1993 | | E04B 2/965 |

OTHER PUBLICATIONS

Brochure for Evolution Thermal and Moisture Protection Roof and Wall Panels, Overly Manufacturing Company, 1 page, Greensburg, PA, Nov. 2010.

*Primary Examiner* — Rodney Mintz
(74) *Attorney, Agent, or Firm* — Cohen & Grigsby, P.C.

(57) ABSTRACT

A covering system for a building substrate is disclosed. The covering system comprises at least two panels having two opposite, gutter shaped joints, and a joint linking system comprising a cleat configured to accept the adjacent joints, a compression cap configured to bridge the adjacent joints, means for attaching the compression cap and cleat to the building substrate, and a cover cap configured to lie flush with the panels and conceal the compression cap and the attaching means. When assembled, the covering system forms a water-tight seal on and prevents water leakage into the building substrate. Further, the covering system provides hidden fasteners, an internal drainage channel which removes any moisture that migrates into the system, and joints which allow for expansion and contraction of the panels during assembly and in the course of environmental changes once installed.

20 Claims, 19 Drawing Sheets

(56) References Cited

U.S. PATENT DOCUMENTS 3,363,383 A * 1/1968 La Barge ..... E04B 1/6175 404/65
3,410,043 A * 11/1968 Rijnders ..... E04B 9/363 52/393
3,667,183 A * 6/1972 Heirich ..... E04F 13/0812 52/464
3,791,088 A * 2/1974 Sandow et al. ..... E04D 3/08 52/200
3,854,260 A * 12/1974 O'Hanlon ..... E04B 1/6175 52/259
3,864,886 A * 2/1975 Thom ..... E04B 1/6804 52/396.04
3,868,802 A * 3/1975 Schubach ..... E04B 2/58 29/450
4,106,252 A * 8/1978 Rutten ..... E04D 3/366 52/464
4,461,131 A * 7/1984 Pressell ..... E04F 15/02 52/395
4,603,528 A * 8/1986 Sigerist ..... E04F 13/0803 52/464
5,078,529 A * 1/1992 Moulton ..... E04B 1/6804 403/24
5,083,405 A * 1/1992 Miller ..... E04B 1/7612 52/204.591
5,220,579 A 6/1993 Hossli
5,220,763 A 6/1993 Armitage
5,259,162 A * 11/1993 Nicholas ..... E04B 1/681 52/463
5,272,849 A * 12/1993 Zahner, III ..... E04D 3/366 52/466
5,481,839 A * 1/1996 Lang ..... E04B 2/967 52/235
5,546,713 A * 8/1996 Voegele, Jr. ..... E04D 3/08 52/202
5,596,851 A * 1/1997 Ting ..... E06B 1/62 52/211
5,678,383 A * 10/1997 Danielewicz ..... E04D 3/06 52/235
5,687,524 A 11/1997 Ting
5,996,301 A * 12/1999 Conterno ..... E04C 2/543 52/413
6,293,070 B1 * 9/2001 Castano ..... E04B 1/3211 52/466
6,499,265 B2 * 12/2002 Shreiner ..... E04B 1/681 404/68
6,735,912 B2 * 5/2004 Riggio ..... E04D 3/08 52/235
6,988,344 B1 * 1/2006 Krueger ..... F16B 5/0635 52/464
7,621,084 B2 * 11/2009 Bilge ..... E04F 13/0814 52/235
7,779,584 B2 8/2010 Arias
7,827,750 B2 * 11/2010 Sondermann ..... E04B 1/681 52/396.04
7,918,064 B2 4/2011 Singleton
8,528,285 B2 * 9/2013 Kornfalt ..... E04F 19/062 52/395
8,578,671 B2 * 11/2013 Labrecque et al. ..... E04B 2/967 52/235
2002/0032997 A1 * 3/2002 Shreiner ..... E04B 1/681 52/393
2002/0124514 A1 * 9/2002 Higgins ..... E04D 3/08 52/235
2003/0079426 A1 * 5/2003 Riggio ..... E04D 3/08 52/235
2003/0205009 A1 * 11/2003 Herbst et al. ..... E04F 13/0889 52/235
2004/0134143 A1 * 7/2004 Boyer ..... E04C 2/292 52/235
2006/0156661 A1 7/2006 Leyg et al.
2010/0031596 A1 * 2/2010 Muehlebach ..... E04F 19/06 52/466
2012/0151867 A1 * 6/2012 Smith et al. ..... E04D 3/28 52/588.1
2014/0260041 A1 * 9/2014 Peck ..... F16B 5/0685 52/489.1
2015/0047286 A1 * 2/2015 Bernat ..... E04F 15/02044 52/588.1
2015/0225962 A1 * 8/2015 Hancock ..... E04F 13/0841 52/468

* cited by examiner

COVERING SYSTEM FOR A BUILDING SUBSTRATE

BACKGROUND

1. Technical Field of the Invention

This invention relates generally to a covering system for a building substrate. More specifically, the invention relates to a covering system which produces a surface having a smooth, planar configuration and which forms a watertight seal on and prevents virtually all water leakage into a building substrate. The system comprises panels having opposite, gutter shaped joints and a joint linking system which conceals both the drainage channels and the means for fastening the panels to the building substrate.

2. Description of the Related Art

Building covering systems have evolved over the years in an effort to improve weather-tightness and resistance to moisture damage as well as to increase insulation capacity. The lack of weather-tightness and poor insulation in roofing systems can be observed in colder climates as ice dams. That is, snow accumulation on a poorly insulated roofing structure frequently leads to ice buildup at the roofs edge. This ice buildup, known as an ice dam, causes water to buildup behind the ice which may lead to water damage of the building substructure, both at the roof line and within the supporting walls.

Panel systems designed to cover various building surfaces have been developed with the aim to reduce such damage. For example, metal panel systems have been developed which provide increased durability and weather resistance. Current metal panels used in roofing systems typically include panels having upstanding joint areas for linking the panels along adjacent margins, often referred to as standing seams. These standing seams can be secured by crimping, welding, interlocking, or soldering to prevent penetration of moisture to the back sides of the panels and the underlying building surface. These attachment points are rigidly fixed, however, and thermal expansion and contraction stresses which accumulate around these points often lead to wear and damage of the underlying building structure. Additionally, points where the panels are attached to the roof substrate also present areas which are vulnerable to moisture entry and consequent water damage.

Recent improvements to these metal panel systems have addressed some of these problems by fastening the panels to the building surface using a batten structure mounted within the joint area of adjacent panels, and by providing a cover which extends over the longitudinal margins and joint area of the adjacent panels. The batten and cover, however, are typically held in place by fasteners which limit expansion and contraction in at least one dimension in response to changes in the ambient temperature. Thus, while such systems provide a mechanism to conceal the attachment means and may allow for some movement, they still do not entirely solve all of the problems of thermal expansion and contraction stresses exerted on a panel system.

Accordingly, there exists a need in the art for a building covering system that may provide a water-tight seal on a building substrate, and which allows for thermal expansion and contraction in multiple dimensions. Further, there exists a need in the art for a building covering system that may increase the insulation value for a building.

SUMMARY

The presently disclosed invention overcomes many of the shortcomings of the prior art by providing a covering system for a building substrate which is weather-tight, has no exposed screws or fastening means, can expand or contract in multiple dimensions under varied environmental conditions or during the installation process, and has channels which collect and carry away moisture which comes into contact with the covering system. Further, the covering system does not have raised battens or standing seams, and thus provides a monolithic appearance.

According to its major aspects, and briefly stated, the present invention includes a covering system for a building substrate comprising at least two panels, a joint linking system, and means for attaching the covering system to the building substrate.

In embodiments, each panel may have a top side and two opposite, gutter shaped joints, wherein sidewalls of each joint are formed at about 90 degrees to a base wall of the joint. The joint linking system may comprise a cleat configured to accept adjacent joints of the at least two panels, a compression cap configured to bridge the adjacent joints, and a cover cap having a top side, wherein the top side of the cover cap may be flush with the top sides of the at least two panels. The means for attaching the covering system to the building substrate may be at least one screw which attaches the compression cap and the cleat to the building substrate.

In embodiments, the sidewalls of each joint may be formed at about 90 degrees to the top side of the at least two panels so that the base wall of the joint and the top side of the panel are on parallel planes. Further, the cover cap may be configured to conceal the compression cap and the at least one screw of the attachment means.

In embodiments, the compression cap comprises a top and a bottom surface, at least two gaskets on the bottom surface which form a watertight seal with a portion of the base wall of each of the adjacent joints of the at least two panels, at least two grooves on the top surface configured to receive sealant material, and a central channel. Sealant material may be placed in the at least two grooves on the compression cap to secure the cover cap and provide a watertight seal between the inner surface of the cover cap and the compression cap. The cleat may further comprise two upright flanges formed at about 90 degrees to a base of the cleat, wherein the central channel of the compression cap is received in the space between said flanges. Further, the central channel on the compression cap may be configured to accept the at least one screw of the attachment means.

In embodiments, the cleat may be sized to allow lateral movement of the adjacent joints of the at least two panels within the cleat. As such, during assembly of the covering system on a building substrate, the panels may be pulled apart or pushed closer together within the cleat to provide size flexibility during construction. After the system is fully assembled and water-tight, changes in weather conditions may cause the panels of the covering system to expand and contract, and the cleat of the present invention allows for such movement without undue stress on the panels or damage to the watertight joint linking system.

In yet further embodiments, the covering system may comprise at least two insulation sheets, wherein each insulation sheet is placed between the building substrate and one of the at least two panels.

In certain embodiments, the covering system may be composed of sheet metal, such as aluminum, stainless steel, titanium, zinc, or copper.

In other embodiments, the panels of the covering system may be roof or wall panels and the building substrate may be a roofing substrate or a wall substrate.

BRIEF DESCRIPTION OF THE DRAWINGS

Aspects, features, benefits and advantages of the embodiments herein will be apparent with regard to the following description, appended claims, and accompanying drawings. In the following figures, like numerals represent like features in the various views. It is to be noted that features and components in these drawings, illustrating the views of embodiments of the present invention, unless stated to be otherwise, are not necessarily drawn to scale.

FIG. 8A shows the panel joint formed with about 90 degree angles and FIG. 8B shows the panel joint formed at angles other than 90 degrees.

DETAILED DESCRIPTION

Figure 1:
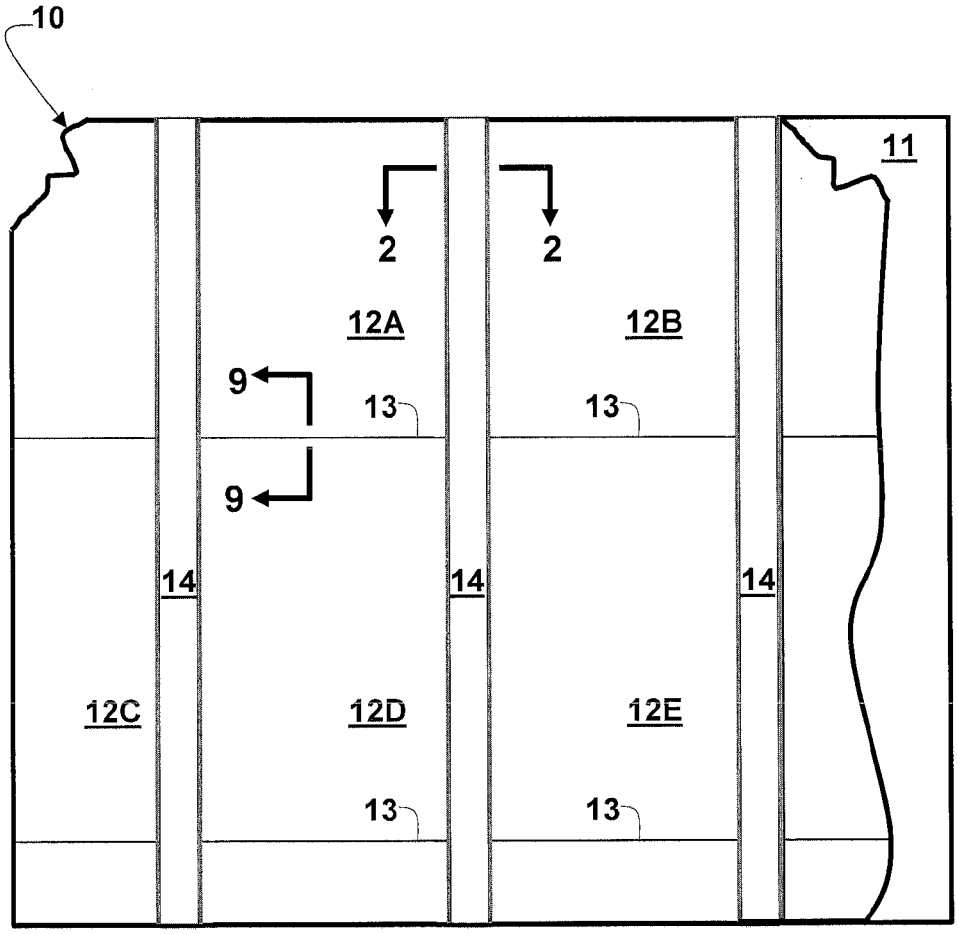
FIG. 1 illustrates a partial plan view of an exterior building surface utilizing the covering system in accordance with certain aspects of the presently disclosed invention.

In the following description, the present invention is set forth in the context of various alternative embodiments and implementations involving a covering system for a building substrate.

Various aspects of the covering system may be illustrated by describing components that are coupled, attached, and/or joined together. As used herein, the terms "coupled", "attached", and/or "joined" are interchangeably used to indicate either a direct connection between two components or, where appropriate, an indirect connection to one another through intervening or intermediate components. In contrast, when a component is referred to as being "directly coupled", "directly attached", and/or "directly joined" to another component, there are no intervening elements shown in said examples.

Relative terms such as "lower" or "bottom" and "upper" or "top" may be used herein to describe one element's relationship to another element illustrated in the drawings. It will be understood that relative terms are intended to encompass different orientations of aspects of the covering system for a building substrate in addition to the orientation depicted in the drawings. By way of example, if aspects of the covering system shown in the drawings are turned over, elements described as being on the "bottom" side of the other elements would then be oriented on the "top" side of the other elements as shown in the relevant drawing. The term "bottom" can therefore encompass both an orientation of "bottom" and "top" depending on the particular orientation of the drawing.

Referring now to the drawings, embodiments of a covering system for a building substrate of the present invention are shown in FIGS. 1-17 generally designated by the reference numeral 10. FIG. 1 illustrates a partial plan view of a building surface covered by an embodiment of the covering system of the presently disclosed invention. Typically, such a building surface may be an exterior surface, such as an exterior wall or roof. The covering system 10 may, however, also be used on any interior building surface where exposure to moisture or water is a concern such as, for example, in a shower, bathroom, kitchen, or wet room. The building surface may be covered by a substrate 11 such as plywood, drywall, or any other material to which the covering system 10 may be attached. Alternatively, the building surface 11 may be a series of exposed beams, studs, or trusses to which the covering system 10 may be attached. In such an arrangement, an intermediate layer of building material may be placed between the beams, studs or trusses to provide for additional insulation, weather-tightness, and/or structural support.

The covering system 10 may comprise at least two panels 12 (shown as panels 12A-12E in FIG. 1) which may be joined at adjacent edges (such as the edges between panels 12A and 12B) by a joint linking system 14, and may overlap at opposite edges (such as the edges between panels 12A and 12D) to form a seam 13. The seam 13 may be formed with a bottom edge of an upper panel (such as panel 12A or 12B) overlapping a top edge of a lower panel (such as panel 12D or 12E) so that moisture may roll over the seam. Further, the joint linking system 14 may extend longitudinally to connect joints on adjacent panels or series of panels, as is shown in FIG. 1. That is, the joint linking system 14 may be longer than the panels 12 so that one joint linking system 14 may connect several panels 12 on a building substrate 11.

Figure 2:
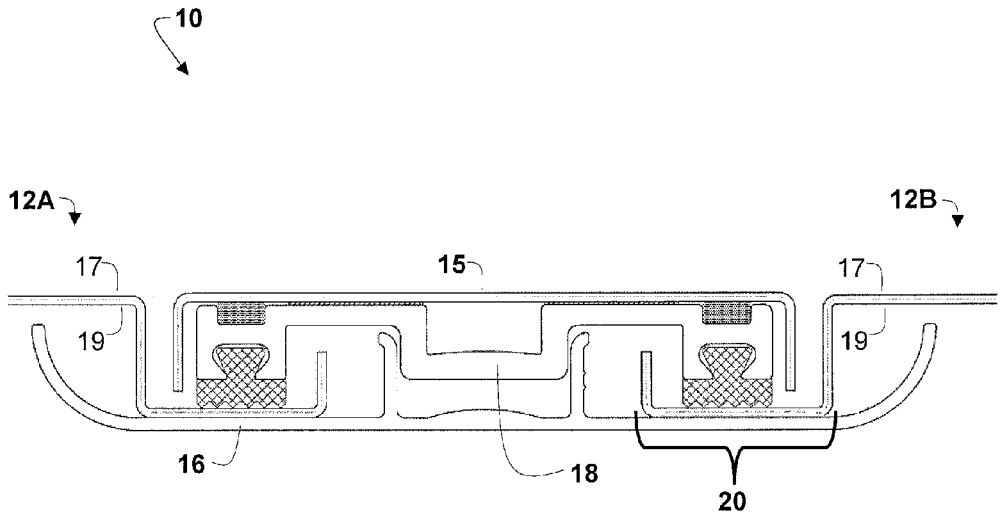
FIG. 2 illustrates a sectional view taken along line 2-2 of FIG. 1 showing the covering system in accordance with certain aspects of the presently disclosed invention.

FIG. 2 illustrates a sectional view taken along line 2-2 of FIG. 1 showing the covering system in accordance with certain aspects of the presently disclosed invention. Each panel (12A, 12B) may have a top side 17 which faces away from the building substrate and a bottom side 19 which faces toward the building substrate. Further, each panel (12A, 12B) may have two opposite, gutter shaped joints 20 which protrude from the panel's bottom side 19. Joints 20 from adjacent panels (12A, 12B) may be connected by a joint linking system (shown as reference number 14 in FIG. 1) comprising a cleat 16, a compression cap 18, and a cover cap 15. More specifically, the joints of adjacent panels (12A, 12B) may be positioned within the cleat 16 and covered by a combination of the compression cap 18 and the cover cap 15.

Figure 3:
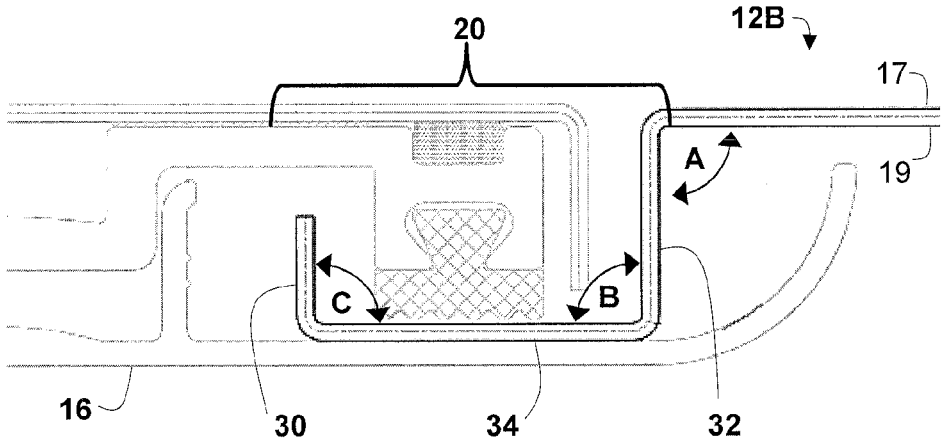
FIG. 3 illustrates a partial sectional view as in FIG. 2 pointing out the edge profile of the covering system in accordance with certain aspects of the presently disclosed invention.

As shown in FIG. 3, each joint 20 of a panel 12B may be formed with a base wall 34 and two upstanding sidewalls (30, 32). The first and second side walls (32, 30 respectively) may be formed at an angle (B, C) of about 90 degrees relative to the base wall 34. Further, the first sidewall 32 may be formed at an angle (A) of about 90 degrees relative to the panel body. Such an arrangement provides a base wall 34 which may lie parallel to a bottom portion of the cleat 16, and which may be on a plane parallel with a top portion 17 of the panel (12B). In embodiments of the covering system of the presently disclosed invention, the angles A, B and C are defined as "about 90 degrees" or "about right angles", terms which may be used interchangeably. Further, use of the qualifier "about" is meant to indicate that the angle may vary from 90 degrees by +5%, or may be between 85 degrees and 95 degrees. In a preferred embodiment, the angles A, B and C may be 90 degrees.

During installation of the covering system 10 on a building substrate 11, no specific means for attachment of the joints 20 directly onto the cleat 16, such as bonding agents, glue, sealants, or the like, may be needed or used. As will be discussed below, attachment means may be placed on a central portion of the cleat 16 and the compression cap 18 (see FIG. 6) which may hold the panels 12 to the building substrate 11. Environmental changes, such as changes in the temperature or humidity, may cause the panels to expand or contract. Since no specific bonding agents may be used at the contact points between the joints 20 and the cleat 16, small amounts of movement may be allowed to occur. This may reduce the wear and stress on the panels, but will not reduce the weathertightness of the covering system of the presently disclosed invention.

Figure 4:
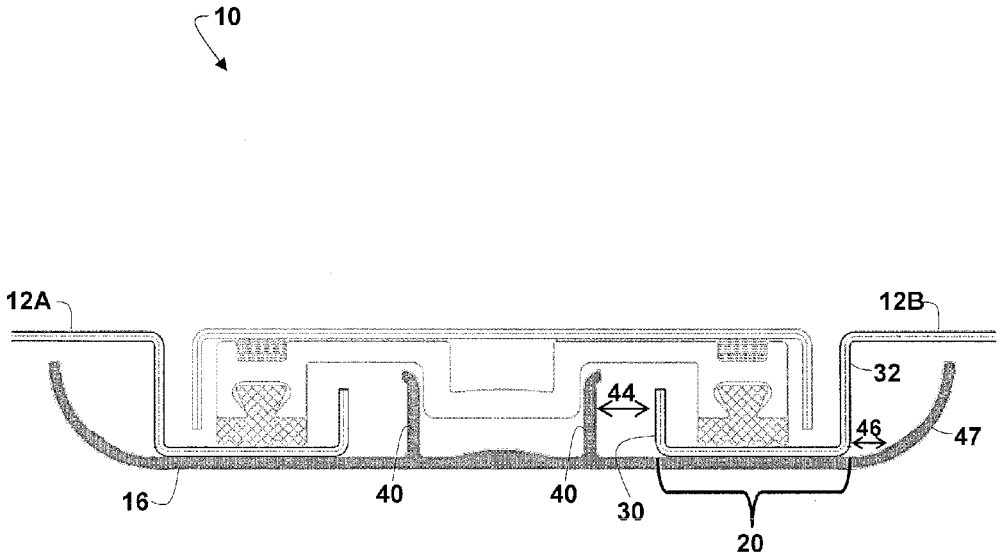
FIG. 4 illustrates a sectional view as in FIG. 2 pointing out various parts of the drain channel of the covering system in accordance with certain aspects of the presently disclosed invention.

As shown in FIG. 4, the cleat 16 may further have two centrally located upright flanges 40. These flanges 40 may be formed at an angle of about 90 degrees relative to a base portion of the cleat 16. Further, the cleat 16 may be proportioned to expansively accommodate the joints 20 from two adjacent panels (12A and 12B). That is, the cleat 16 may be sized so that the joints 20 have space (44 and 46) within which to move laterally. The space 46 between the first sidewall 32 and the edge of the cleat 47 and the space 44 between the second sidewall 30 and the flange 40 allows the joint 20 to have lateral movement within the joint linking system. This lateral movement may allow for expansion and contraction of the panels 12 during assembly of the covering system 10 and in the course of environmental changes once installed on a building substrate.

While the flanges 40 are shown in FIG. 4 to be formed at about 90 degrees relative to a base portion of the cleat 16, any other angle is possible and within the scope of the present invention. Furthermore, as shown in FIG. 4, the space 46 within which a joint 20 may move laterally is limited by the upwardly curving sides 47 of the cleat 16. In certain embodiments, the sides 47 of the cleat 16 may be formed at a defined angle relative to the base portion of the cleat such as, for example, about 90 degrees.

Figure 5:
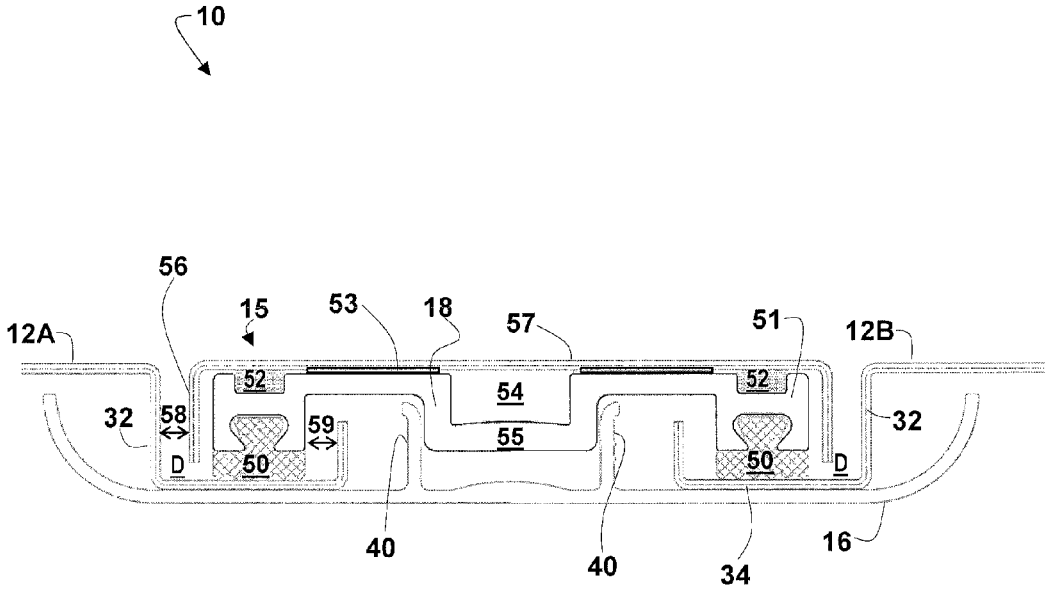
FIG. 5 illustrates a sectional view as in FIG. 2 pointing out various parts of the compression cap and cover cap of the covering system in accordance with certain aspects of the presently disclosed invention.

As shown in FIG. 5, the joint linking system may also comprise a compression cap 18 and a cover cap 15. The compression cap 18 may be configured to bridge and fit within the joints 20 (see FIG. 4) of the two panels (12A, 12B). Further, the compression cap 18 may comprise at least two gaskets 50 on a bottom surface which may form a watertight seal with a portion of the base wall 34 of each adjacent joint. These gaskets 50 may be secured onto the compression cap 18 by any means known in the art. For example, as shown in FIG. 5, a top portion of the gaskets 50 may be shaped so that they fit within a comparably shaped groove on a bottom side of an end portion 51 of the compression cap 18. Alternatively, the gaskets may be attached to a bottom side of the end portions 51 of the compression cap 18 using glue or any other fastening means known in the art.

The compression cap 18 may also comprise a central channel 55 which may be configured to fit within and between the upright flanges 40 of the cleat 16. Further, the central channel 55 may be configured to accept at least one attachment or fastening means for attaching the covering system 10 to a building substrate. For example, the central channel 55 may comprise at least one hole sized to fit the shank of a screw or nail. Attachment of the covering system 10 to the building substrate may be achieved by driving the screw or nail through the compression cap 18 via the hole and then through the cleat 16 into the building substrate. In embodiments, the cleat 16 may be configured to accept at least one attachment or fastening means. That is, the cleat 16 may also have at least one hole sized to fit the shank of a screw or nail.

The holes of the cleat 16 and the compression cap 18 may be spaced to coincide in relative position during installation of the joint linking system so that the screw or nail may be driven through the respective holes in the compression cap 18 and cleat 16 into the building substrate. The holes may be sized to accommodate various dimensions of attachment means. Further, the holes may allow for movement (expansion/contraction) of the joint linking system in the course of environmental changes once installed on a building substrate. That is, the holes may be shaped as slots so that movement may occur in at least one direction, or may be larger than the size of the attachment means so that movement may occur in multiple directions. In the latter case, if the hole is sized larger than the head of the attachment means, such as the head of the screw or nail, a washer may be used to secure the attachment means. Such variation in attachment means would be known by one having ordinary skill in the art. In certain embodiments, washers may be included to provide additional moisture protection. For example, washers may be control seal washers, self-sealing washers, rubber or neoprene washers.

Further, the space 54 formed between the cover cap 15 and the central channel 55 of the compression cap 18 may be sized to contain a top portion of the fastening or attachment means such as the head of a screw or nail. Thus, once the cover cap 15 is installed over the compression cap 18, both the compression cap 18 and any exposed portions of the fastening or attachments means (e.g., screw or nail heads, washers) used to secure the covering system 10 to the building substrate may be entirely concealed from view.

The cover cap 15, which conceals the attachment means, may be comprised of a top portion or panel 57 having two sidewalls 56 extending therefrom. The two sidewalls 56 may extend from edges of the top panel 57 which are adjacent to the joints 20 of the panels (such as panels 12A and 12B) when the cover cap 15 is installed. As shown in FIG. 1, the joint linking system 14, which includes at least the cleat 16, the compression cover 18, and the cover cap 15, extends longitudinally with respect to the joints 20 of the adjacent panels.

An inner surface of the top panel 57 of the cover cap 15 may be securely attached to the compression cap 18 using a sealant such as, for example, a moisture proof sealant. As such, the compression cap 18 may have an additional set of channels 52 on a top side of the end portion 51 which may accept a sealant material. This sealant material may be applied within the channel 52 during installation of the covering system 10 onto a building substrate. In embodiments, the sealant may provide a watertight seal between the cover cap 15 and the compression cap 18, and may thus restrict water or moisture from entry to the attachment means used in the central channel 55.

Further, to facilitate installation of the cover cap 15 onto the compression cap 18, a top side of the compression cap 18, or an inner surface of the top panel 57 of the cover cap 15, may have a double sided tape 53 or other means for rapid and at least temporary attachment of the cover cap 15 to the compression cap 18. This attachment means may aide in holding the cover cap 15 in place over the compression cap 18 during the period before the sealant in the compression cap channels 52 is cured.

Upon installation, the cover cap 15 may be flush or coplanar with the panels 12A and 12B. As such, the covering system 10 produces a surface having a smooth, planar configuration. The compression cap 18 and cover cap 15 may be sized to provide space (58 and 59) in which they may move laterally within the joints of the panels (12A and 12B). As mentioned above, this lateral movement may allow for expansion and contraction of the panels during assembly and in the course of environmental changes once installed. Further, the space 58 between the first sidewall 32 of the joint, and the gasket 50 and end portion 51 of the compression cap 18 provides a channel D within which moisture may be carried away from the covering system 10.

Figure 6:
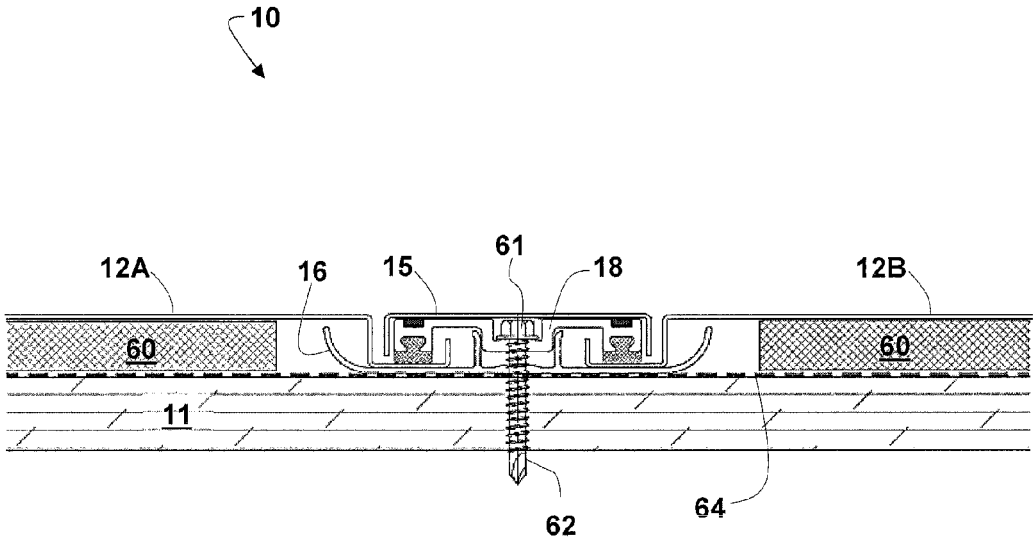
FIG. 6 illustrates a sectional view as in FIG. 2 showing assembly of the covering system on a building substrate in accordance with certain aspects of the presently disclosed invention.

Referring now to FIG. 5 and FIG. 6, a method of installing the covering system 10 will be described. A building substrate 11 may be covered with a water resistant or waterproof barrier or membrane 64. A cleat 16 may be position on the waterproof barrier 64 or directly on the building substrate 11. Insulation sheets 60 may be arranged on either side of the cleat 16. These insulation sheets 60 may be overlaid with panels (12A, 12B) so that the joints from adjacent panels are positioned within the cleat 16. The panels (12A, 12B) conceal and protect the insulation sheets 60. A compression cap 18 may be positioned over the cleat 16 with the central channel 55 fitting within the space between the two upright flanges 40. This may aid in holding the panels 12A and 12B, and cleat 16 in place. Fastening or attachment means 62, such as a nail or screw, may now be driven through the coincident holes on the compression cap 18 and cleat 16, and into the building substrate 11. Installation of the fastening or attachment means may compress the gasket 50 of the compression cap 18 against the base of the joint, and thus may provide for improved weather tightness of the covering system 10.

Prior to installation of the cover cap 15, waterproof sealant may be deposited in the channels 52 which lie on the top side of the compression cap 18. A double sided tape which is initially adhered to either the underside of the cover cap 15 or the top side of the compression cap 18 may be uncovered or exposed and may aid in holding the cover cap 15 in place on the compression cap 18 until the sealant cures. Once the sealant cures, there should be no regions on the building substrate 11 that may come into contact with moisture. Further, any moisture that may accumulate on the covering system 10 will be directed to the channels D (shown in FIG. 5) and will be guided away from the building surface.

With continued reference to FIG. 6, the insulation panels 60 may be generally rectangular boards of standard thickness, and may be formed of any material known in the art. For example, the insulation panels 60 may be covering boards made of lightweight foam such as foamed expanded polystyrene, foamed polyisocyanurate, or foamed polyurethane. Other exemplary materials for the insulation panels 60 include fiberglass, mineral wool, cellulose board, cement board, plywood or oriented strand board. Each panel may be of any standard length, width, or thickness known in the art. In an exemplary embodiment, the insulation panels 60 may be formed of ¼ to ½ inch thick closed cell polyisocyanurate foam. Further, the insulation panels 60 may be sized to fit under a panel 12 between the opposite gutter shaped joints, and may be shorter than, the same length as, or longer than the panel 12 in a longitudinal direction (that is, in the region between seams 13 as shown in FIG. 1). The insulation boards 60 may be provided cut to size. Alternatively, and in order to expedite the use of the insulation board 60 by personnel installing the building covering system, the boards may be easy to cut to size so that building surfaces having non-standard configurations may be accommodated.

Other attributes of the insulation panels 60 may depend of the building substrate to which the covering system is to be attached. For example, insulation panels 60 which may be used on a roofing substrate may need to have higher compression strength than those which are used for a wall or soffit application. Roofing applications may benefit from insulation panels having compression strengths of 80 PSI or greater so that loads placed on the covering system during maintenance do not compress or dent the insulation panels 60. Insulation panels 60 used in wall and soffit applications would not be exposed to the same maintenance loads and, as such, may only need to have compression strengths of 20 PSI or greater. Further, insulation panels 60 having mold resistance according to ASTM D3273 may be advantageous in areas exposed to moisture.

Figure 7:
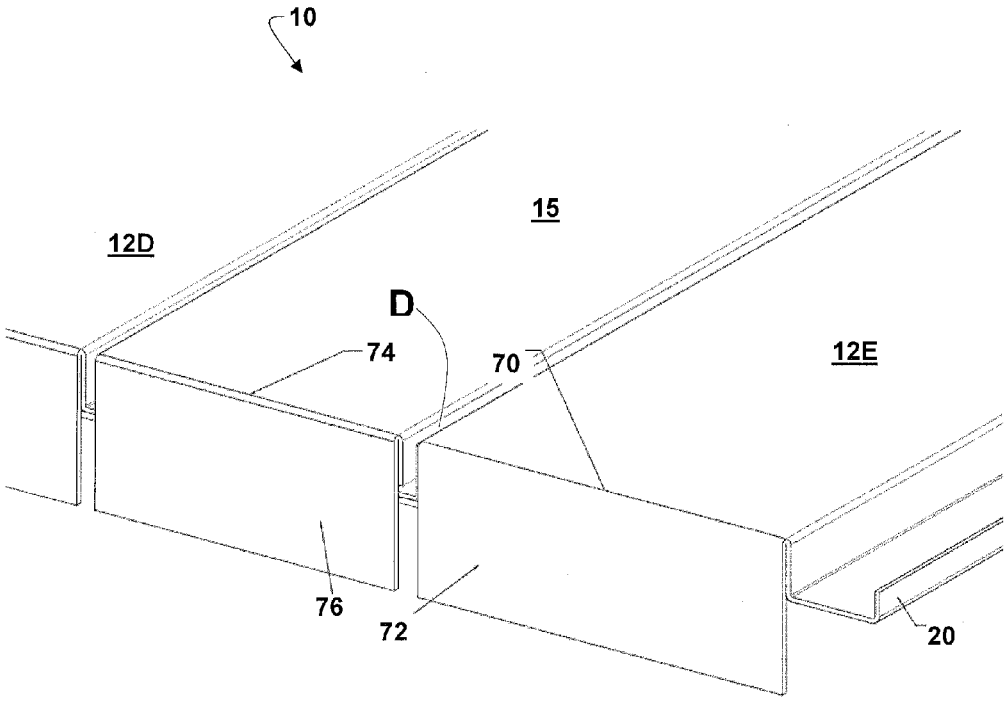
FIG. 7 illustrates a perspective view showing the bent ends of the cover cap and panels at the eaves of a roofing substrate in accordance with certain aspects of the presently disclosed invention.

In all applications, light weight, fire resistance, water resistance, mold resistance and low water absorption properties are advantageous features of any insulation board 60 selected for the covering system of the presently disclosed invention. In the event that an insulation board is selected which does not have these properties, such as plywood or oriented strand board, the waterproof or water resistant barrier or membrane 64 may be placed over the insulation board 60 and the panels 12 and joint linking system 14 may be installed over that. Further, materials used for the insulation boards 60 may be treated to impart these qualities. Exemplary insulation board 60 materials providing one or more of the aforementioned qualities include at least Firestone ISOGARD™ HD cover board, Firestone DensDeck® cover board, Firestone Fiber-Top cover board, Johns Mansville Invinsa® FR Roof Board, and Hunter H-Shield HD In embodiments where this covering system 10 may need to end at an edge such as, for example, a roof edge or eave, the panels 12 and the cover cap 15 may be bent at the point where the covering system meets the edge. As shown in FIG. 7, each panel 12E may be bent along an edge 70 so the end of each panel covers the edge of the building substrate. The bent portion 72 of each panel 12E may have any length needed to cover at least a portion of the building substrate edge. Further, the cover cap 15 may be bent along an edge 74 so the end of the cover cap covers the end of the building substrate. Similarly, the bent portion 76 of the cover cap 15 may have any length needed to cover at least a portion of the building substrate edge. The remaining portion of the joint linking system 14 (the cleat 16, compression cap 18, and joints 20, as shown in FIG. 2) remains unbent and extends to the edge of the building substrate at a point just prior to the bend edge 74 of the cover cap 15. That is, the cleat 16, compression cap 18, and joints 20 remain unbent and the respective ends of these components that extend to the edge of the building substrate are also covered by the bent portion 76 of the cover cap 15.

The bend 70 in the panel 72 and the bend 74 in the cover cap 76 may be the same or different, and may be any angle required to cover an end of a specific building substrate. For example, the cover cap 15 and panel 12D or 12E may be bent to an angle of about 90 degrees, as is shown in FIG. 7.

As shown in FIG. 7, a space or gap exists between the bent ends of the panels (72 for panel 12E) and the bent end of the cover cap 76. This gap corresponds to the channel D shown in FIG. 5 which allows any moisture that may accumulate on the covering system 10 to be directed away from the building surface. In embodiments, this gap (channel D) is not covered by the bent ends of the panels (72 for panel 12E) and the cover cap 76. Further, with reference to FIG. 8A, the selection of about 90 degrees for angles A and B allows channel D to be formed in such a manner that moisture which accumulates in the channel D is directed away from the covering system unimpeded. That is, moisture that may collect on the covering system may accumulate in channel D and may exit from the edge of the channel unimpeded by the bent regions of the panels 72 or the cover cap 76. This last benefit is advantageous in situations where the covering system is used as a roofing system. In the event that debris which falls or blows onto the roofing system accumulates in channel D, as is the case with standard house gutters, this material will be readily cleared from the channel by the action of gravity and/or moisture.

Figure 8A:
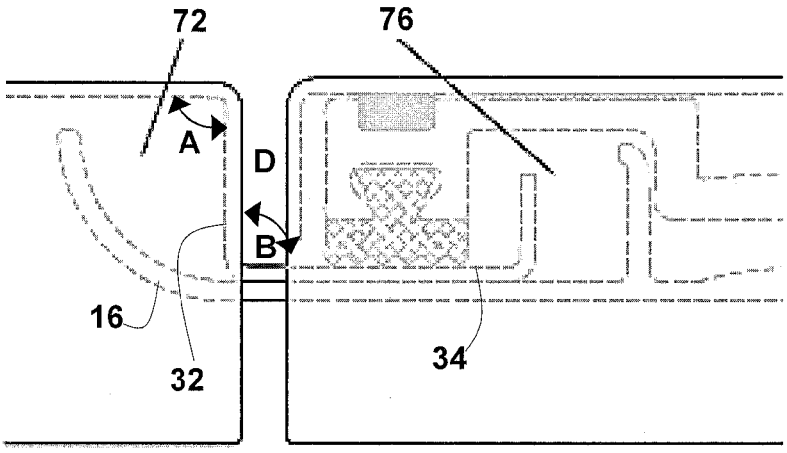
FIGS. 8A and 8B illustrate a sectional view as in FIG. 2 showing the bent ends of the cover cap and panels of the covering system in accordance with certain aspects of the presently disclosed invention, where
Figure 8B:
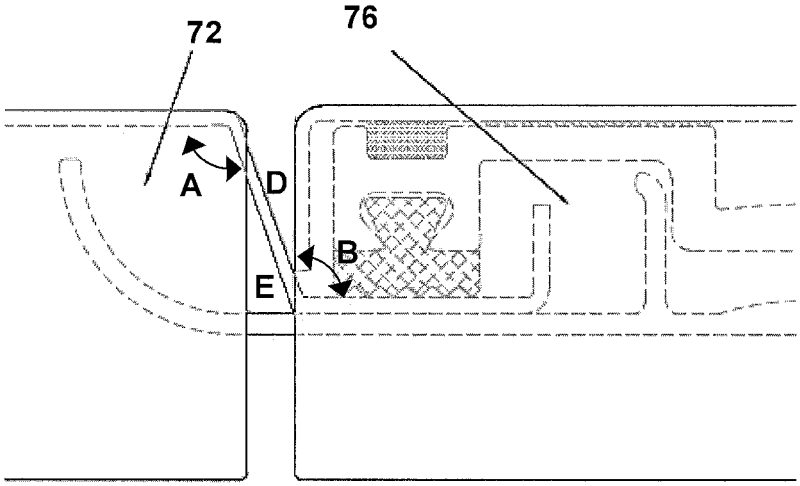

If the angles A and B are selected to be greater than about 90 degrees, as is shown in FIG. 8B, a portion of channel D may be covered by the bent portion of the cover cap 76 and such debris may gather at this point. Further, an additional internal channel E may be formed which could allow entry of moisture and/or debris into an unsealed region of the covering system. Extending the width of the bent portion of the panel 72 would close this internal channel E, but may also occlude the external channel D which is needed to direct accumulated moisture and debris away from the covering system.

Another advantage to the selection of about 90 degrees for the angles A, B and C (as shown in FIGS. 3 and 8A) is evident upon installation of the covering system on a building substrate. During installation, the about 90 degree angles allow for increased lateral tolerances per panel width. That is, the installer has some flexibility during the installation process on how close each panel may be placed with respect to the next panel. This may increase productivity and reduce costs of installation. After installation, the increased tolerances reduce the risk of leaks or damage to the covering system caused by environmental changes, such as changes in the temperature or humidity, which may cause the panels to expand or contract.

Further, the selection of about 90 degrees for the angles A, B and C (as shown in FIGS. 3 and 8A) provides a more aesthetically pleasing product once installed on a building substrate. As is evident from the illustration in FIGS. 7 and 8A, there are no visible joints or internal sections at a building substrate edge. When angles A and B are other than about 90 degrees, as is shown in FIG. 8B, there are exposed internal sections which are visible and may detract from the aesthetic quality of the installed cover system.

In use, the panels 12 may be installed in end-to-end or end-over-end overlapping configurations at predesigned spaced intervals along a building surface (see for example seams 13 of FIG. 1). The ends may be attached and made more moisture resistance through the use of various end-linking systems which are illustrated in FIGS. 9-17B, each of which illustrate the same sectional view of the building covering system taken along line 9-9 of FIG. 1. In each of the following figures, the building surface 11 is shown to be covered by a water resistant barrier or membrane 64 and at least one insulation board 60. As mentioned above, the water resistant barrier or membrane 64 may alternatively be placed over the insulation board 60, or may be omitted.

Figure 9:
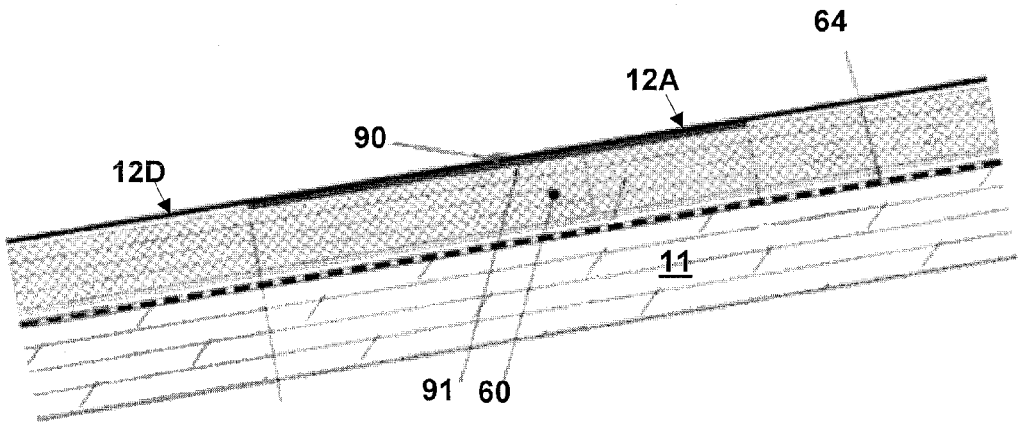
FIG. 9-FIG. 17B illustrate a sectional view taken along line 9-9 of FIG. 1 showing the covering system of various embodiments in accordance with certain aspects of the presently disclosed invention.
Figure 10:
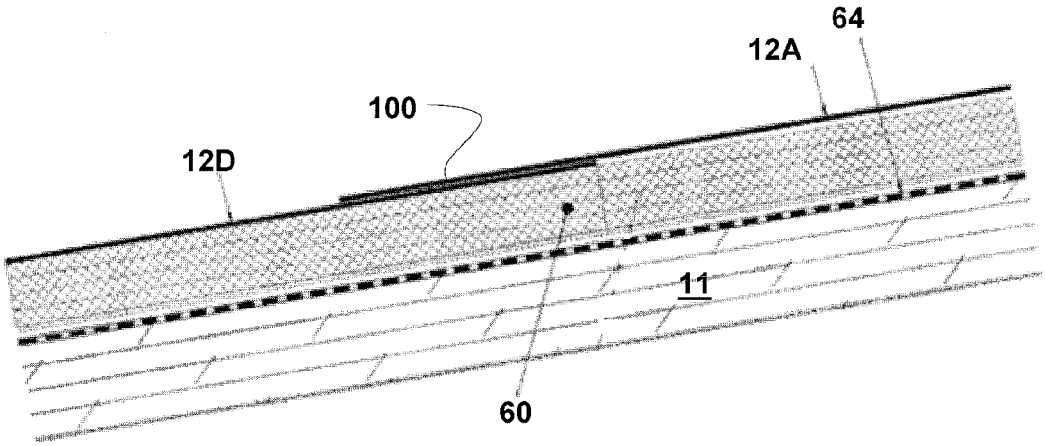
Figure 11:
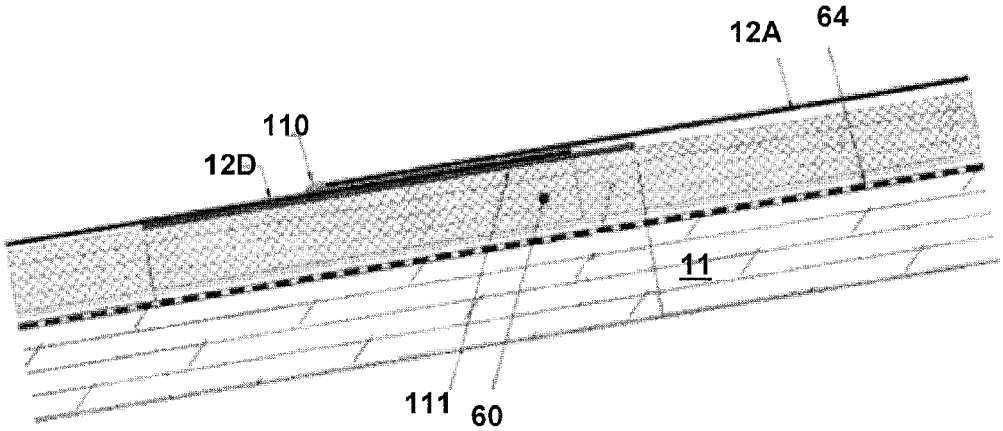

FIG. 9 illustrates a simple configuration for attachment of the longitudinal ends of the panels (shown as 12A and 12D), which may be abutted over the insulation board 60. The panels may be soldered or welded to provide a solid, waterproof, and permanent connection (shown as solder or weld point 90). In cases where welding is used, a layer of fire retardant paper 91, such as a cellulose fire retardant paper, may be included directly under the solder or weld point 90 in order to protect the insulation board 60 and other panel components during the welding process. In an exemplary embodiment, the layer of fire retardant paper 91 may be about 4 inches wide and may extend the full length of weld. Alternatively, several portions of fire retardant paper 91 may be used to provide the correct wide and length required to protect the insulation board 60 and other panel components during the welding process FIG. 10 illustrates an alternative configuration for the attachment of the longitudinal ends of the panels 12A and 12D, wherein a first panel 12A in overlaid upon a second panel 12D. The amount of overlap 100 between the two panels may depend on several factors, including at least the location of installation of the building covering system and the size of the space to be covered by the building covering system. In an exemplary embodiment, the two panels may overlap by about 2 inches. Further, and as shown in FIG. 11, the overlap region of the two panels 12A and 12D may be welded to provide a solid, waterproof, and permanent connection (shown as solder or weld point 110). As mentioned above, a layer of fire retardant paper 111, such as a cellulose fire retardant paper, may be included under the weld point 110 in order to protect the insulation board 60 and other panel components during the welding process. Any other means for connection of the two panels 12A and 12D in the overlap region (100 of FIG. 10) known in the art is within the scope of the present invention, such as various adhesive tapes, glues, caulks or sealants.

Figure 12:
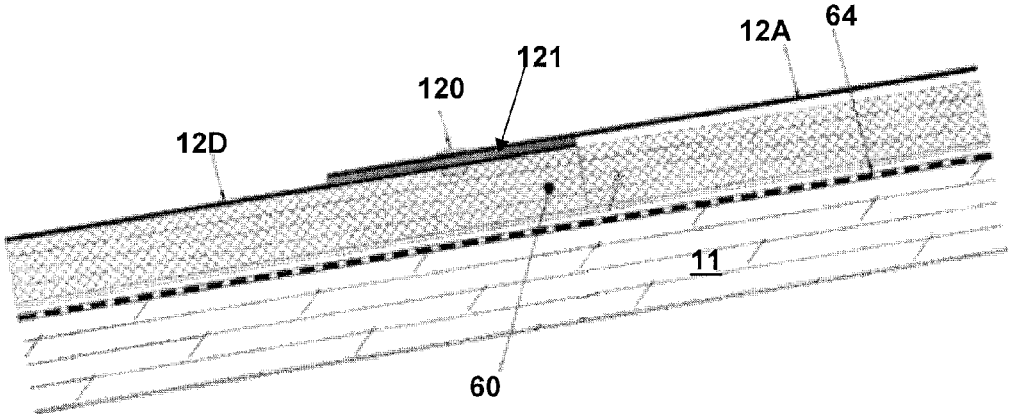
Figure 13:
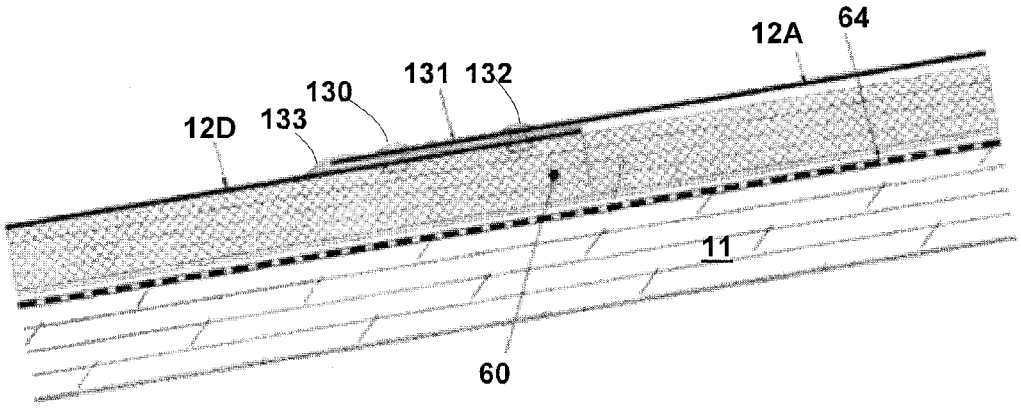

As shown in FIG. 12, the overlap region may be connected via a single cinch lock, spot weld, solder, screw, nail, or rivet 120. As shown, panel 12A overlaps panel 12D, and the two panels are connected by a rivet 120. The region of overlap between the two panels may be made more waterproof or weather tight by the addition of a sealant, glue, caulk or tape 121. Alternately, a very high bond ("VHB") tape may be used alone or in combination with the connection means (screw, nail, or rivet 120). Moreover, more than one connection means may be used, such as rivets 130 and 132 shown in FIG. 13. As shown in FIG. 13, the region of overlap between the two panels may be made more waterproof or weather tight by the addition of a sealant, glue, caulk or tape 131 alone or in combination with a more extensive weld or solder region 133.

Figure 14:
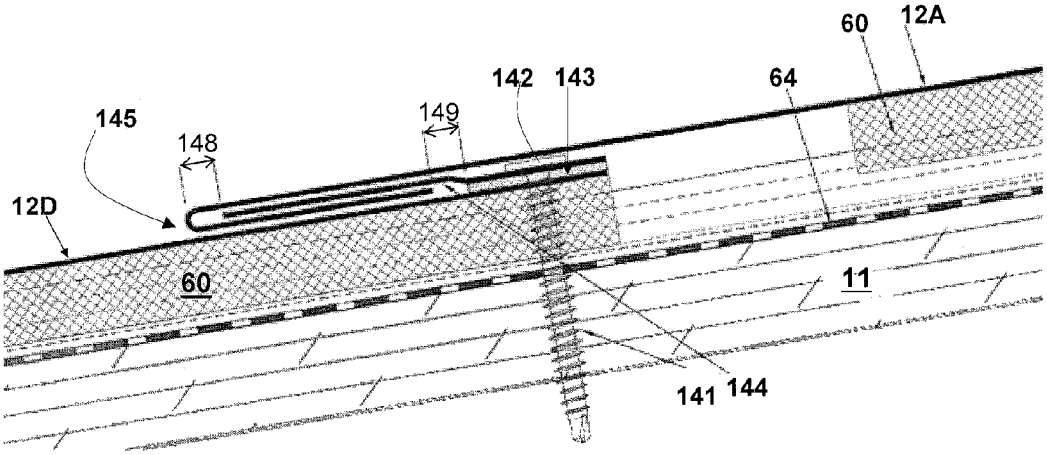

As shown in FIG. 14, each panel 12 may have one bent edge or end 145 adjacent to the gutter shaped joints. This bent edge 145 (shown as an end of panel 12A) may be secured to a corresponding hook 144, which may be attached to an adjacent panel (shown as an end of panel 12D). During installation of the covering system 10, the hook 144 may be attached to a lower panel 12D using any attachment means known in the art, such as a screw 141, rivet or nail. A gasket 143 may be placed between the hook 144 and the portion of the lower panel 12D to which the hook 144 is to be attached to provide a more water-tight seal for the screw 141 on the panel 12D. The bent edge 145 of the upper panel 12A may then be secured over the hook 144. An upward bend in the hook 144 may be formed to allow space for the upper panel 12A end and/or space for the top of the fastening means 142.

The hook 144 may be placed at any position on the lower panel, such as at an upper end as shown for panel 12D in FIG. 14. For ease of installation, however, the hook 144 may be placed away from the end of the panel so that various building surface sizes may be more easily accommodated. That is, standard length panels may be used in situations where panels of a slightly shorter length would be needed. The hook 144 may be placed away from the edge of the panel by a distance that may essentially shorten the panel once installed on the building surface 11.

The bent edge 144 and the hook 145 may be sized to provide spaces 148 and 149. These spaces (148, 149) may allow for movement of the upper panel 12A with respect to the lower panel 12D during installation and in the course of environmental changes once installed on a building substrate 11. Sealant may be used at the contact points between the hook 144 and the inside of the bent edge 145 of the upper panel 12A. Alternately, a weld or solder point may be placed at the region between the bent edge 145 of the upper panel 12A and the lower panel 12D (not shown).

The hook 144, which is attached to an end of the lower panel 12D, may be attached using a screw 141 which may be driven through the hook 144, gasket 143, panel 120, insulation panel 60, and into the building substrate 11. As mentioned above, a weather-tight barrier layer 64 may be included between the building substrate 11 and the insulation panels 60. Such a barrier may be any type of barrier known in the art such as a waterproof membrane (plastic or rubber), paper sheeting, foils, etc.

Figure 15:
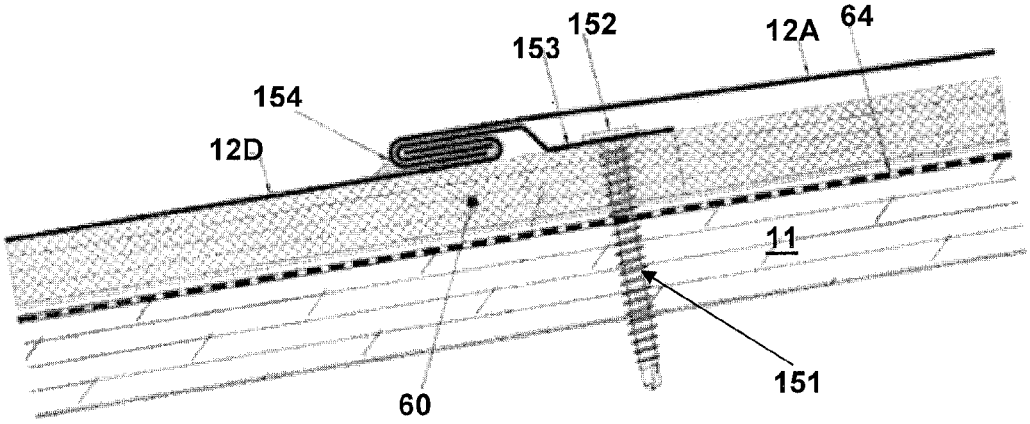

As shown in FIG. 15, both the upper panel 12A and the lower panel 12D may have bent edges adjacent to the gutter shaped joints. In certain embodiments, the bend in the edge of the upper panel 12A may cause the end of the panel to fold under with respect to the building surface, while the bend in the edge of the lower panel 12D may cause the end of the panel to fold upward with respect to the building surface. In such an arrangement, the two bent edges may be secured or hooked together as shown in FIG. 15. To more securely attach the panels to the building surface, a separate hook 153 may be secured over the bent end of the lower panel 12D and may be attached directly to the insulation board 60 using any attachment means known in the art, such as a screw 151, rivet or nail. The bent end of the upper panel 12A may then be secured over the hook 153 and bend end of the lower panel 12D. Sealant may be used at the contact points of the hook 153, the bent edge of the upper panel 12A, and the bent edge of the lower panel 12D. Alternately, a weld or solder 154 may be placed at the region between the bent edge of the upper panel 12A and the lower panel 12D. An upward bend in the hook 153 may be formed to allow space for the upper panel 12A end and/or space for the top of the fastening means 152.

Figure 16A:
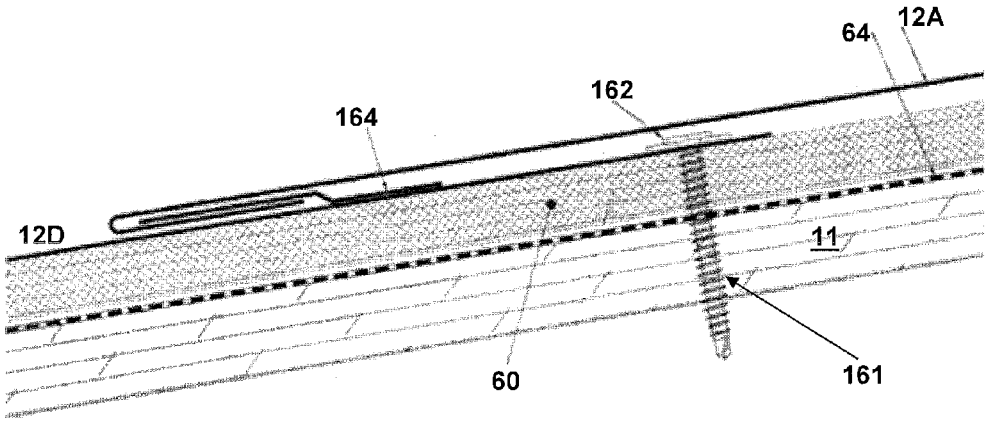

Shown in FIG. 16A is a configuration for attachment of the longitudinal ends of the panels 12A and 12D which is a slight variation of the arrangement shown in FIG. 14. Specifically, the hook 164 may be attached to a point on the lower panel 12D which is below the point at which the lower panel 12D is attached to the insulation board 60 and building substrate 11. Attachment of the hook 164 to the lower panel 12D may be by via a single cinch lock, spot weld, solder, screw, nail, rivet or any combination thereof. An end of the lower panel 12D may then be attached to the insulation board 60 and building substrate 11 using any fastening means known in the art such as, for example, a screw 161. The screw 161 may be made weather tight on the lower panel 12D by placing a gasket or washer between the screw head 162 and the lower panel 12D. The bent edge of the upper panel 12A may then be secured over the hook 164.

Figure 16B:
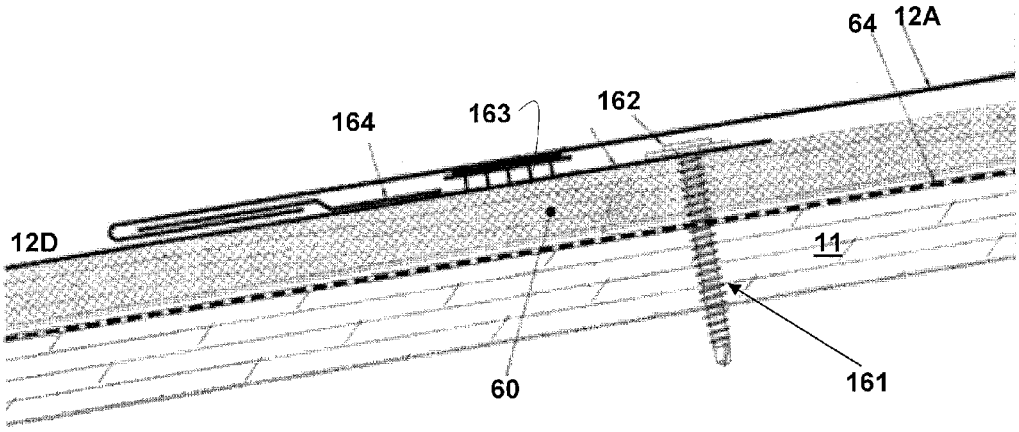

With continued reference to FIG. 16A, an upward bend in the hook 164 may be formed to allow space for the upper panel 12A end and/or space for the top of the fastening means 162. Further, the upward bend in the hook 164 may allow space for a gasket 163, as shown in FIG. 16B, in the region of connection between the upper panel 12A and the lower panel 12D. Inclusion of a gasket 163 may improve the weather and/or water tightness of the connection between the two panels.

Figure 17A:
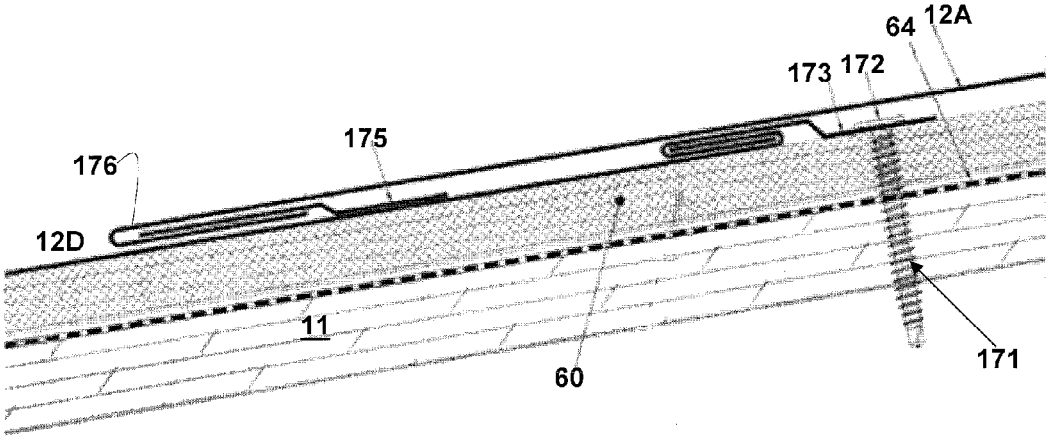

Shown in FIG. 17A is a further alternative configuration for attachment of the longitudinal ends of the panels 12A and 12D. As shown in FIG. 17A, a first hook 175 may be attached to a point on the lower panel 12D which is below the point at which the lower panel 12D is attached to the insulation board 60 and building substrate 11. This attachment may be by via a single cinch lock, spot weld, solder, screw, nail, rivet or any combination thereof. An end of the lower panel 12D comprising a bent edge may then be secured to a second hook 173 which may be attached to the insulation board 60 and building substrate 11 using any fastening means known in the art such as, for example, a screw 171. The screw 171 may be made weather tight on the lower panel 12D by placing a gasket or washer between the screw head and the lower panel 12D.

Figure 17B:
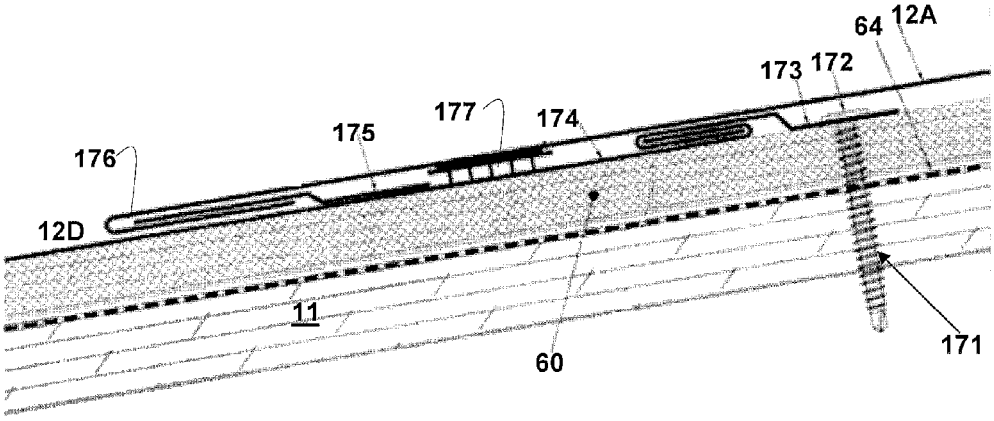

With continued reference to FIG. 17A, the bent edge 176 of the upper panel 12A may then be secured over the first hook 175. An upward bend in the both the first hook 175 and the second hook 172 may be formed to allow space (174 of FIG. 17B) for the upper panel 12A end and/or space for the top of the fastening means 172. Further, the upward bend may allow space 174 for a gasket 177, as shown in FIG. 17B, in the region of connection between the upper panel 12A and the lower panel 12D. Inclusion of a gasket 174 may improve the weather and/or water tightness of the connection between the two panels.

In certain embodiments, any combination of the above mentioned connection means as shown in FIGS. 9-17 may be used to connect one panel to another, and/or may be used alone or in combination to connect all of the panels along seams 13 of FIG. 1 in the building covering system of the presently disclosed invention.

The covering system 10 of the presently disclosed invention is preferably employed for exterior cladding such as roofs and walls. This system, however, is versatile and may be employed for architectural details such as columns, or for anchoring interior panels as well. Further, the panels can be curved and/or tapered for barrel vaults and domes or spherical shapes. The system is the exterior exposed component of a building surface composite assembly.

As shown in FIG. 1, embodiments of the covering system of the present invention produce a surface having a smooth, planar configuration. Further, the covering system forms a watertight seal on and prevents water leakage into a building substrate. Water or moisture that does accumulate on the covering system is collected in drainage channels (region labeled D in FIG. 5) which direct the moisture away from the building surface. Since the drainage channels are open at each end of a joint linking system, multiple connected panels may form a single extended channel which may direct the moisture away from the surface of a building.

An exemplary embodiment of the covering system 10 of the present invention may have panels 12 of sheet metal construction of 10 to 26 gauge. For example, the sheet metal may be stainless steel of 20 to 26 gauge, aluminum of 16 to 20 gauge, copper of 10 to 20 ounce, zinc of 20 to 24 gauge, and titanium of 24 to 26 gauge. Other metals such as, for example, galvanized steel or brass, or any suitable metal or synthetic resin material are also within the scope of the present invention.

The panels 12 are preferably of generally rectangular shape; however the ends or sides nearest an end or edge of a building surface may be tapered to various other shapes such as, for example, a trapezoidal shape, for special architectural applications. The panels may be roll formed in 20 to 40 foot (6.1 to 12.2 meter) lengths. In especially preferred embodiments, the panels 12, cleat 16, compression cap 18, and cover cap 15 may be of unitary construction, although spot welding of components may be employed.

Several representative dimensions for an exemplary covering system 10 will be described below with reference to FIG. 5. The panels 12 and cover cap 15 may be composed of a metal as described above having a thickness of about 0.04 inches, and may be painted or protected with a surface coating or finish. The cleat 16 and compression cap 18 may be composed of a lightweight aluminum formed by a channel extrusion process. The cover cap 15 may have a diameter of about 2.75 inches, with downward sloping sides 56 which are about 0.4 inches in length. Thus, an exemplary insulation board 60 would be a single ½ inch board or two layers of a ¼ inch board.

With continued reference to FIG. 5, the compression cap 18 may have a diameter of about 2.54 inches, which is smaller than the diameter of the cover cap 15, and thus provides tolerance to facilitate installation. Further, the spaces 58 and 59 shown in FIG. 5 provide additional tolerances to facilitate installation and are the result of the width of the gutter shaped joint 20, generally about 0.76 inches, which is larger than the width of the end portion 51 of the compression cap 18, generally about 0.39 inches.

While specific embodiments of the invention have been described in detail, it should be appreciated by those skilled in the art that various modifications and alternations and applications could be developed in light of the overall teachings of the disclosure. Accordingly, the particular arrangements, systems, apparatuses, and methods disclosed are meant to be illustrative only and not limiting as to the scope of the invention.

What is claimed is:

1. A covering system for a building substrate, comprising:

at least two panels, wherein each of the panels comprises a top side and two opposite, gutter shaped joints, wherein the joints have two sidewalls formed at about 90 degrees to a base wall;

a cleat configured to accept adjacent joints of the at least two panels;

a compression cap configured to bridge the adjacent joints;

a cover cap having a top side, wherein the top side of the cover cap is sh with the top sides of the at least two panels; and means for attaching the covering system to the building substrate, wherein the cleat is sized to allow lateral movement of the adjacent joints of the at least two panels within the cleat.

2. The covering system for a building substrate of claim 1, wherein the means for attaching the covering system to the building substrate includes at least one screw which secures the compression cap and the cleat to the building substrate.

3. The covering system for a building substrate of claim 1, wherein the sidewalls of each joint are formed at about 90 degrees to the top side of the panel so that the base wall of the joint and the top side of the panel are on parallel planes.

4. The covering system for a building substrate of claim 1, wherein the cover cap conceals the compression cap and the means for attaching the covering system to the building substrate.

5. The covering system for a building substrate of claim 1, further comprising at least two insulation sheets, wherein each insulation sheet is placed between the building substrate and one of the at least two panels.

6. The covering system for a building substrate of claim 1, wherein the at least two panels are composed of sheet metal.

7. The covering system for a building substrate of claim 1, wherein the compression cap comprises:

a top surface and a bottom surface;

at least two gaskets on the bottom surface which form a watertight seal with a portion of the base wall of each of the adjacent joints of the at least two panels;

at least two grooves on the top surface configured to receive a sealant material; and a central channel.

8. The covering system for a building substrate of claim 7, wherein the sealant material placed in the at least two grooves on the compression cap secures the cover cap and provides a watertight seal between an inner surface of the cover cap and the compression cap.

9. The covering system for a building substrate of claim 7, wherein the cleat comprises two upright flanges formed at right angles to a base of the cleat, wherein the central channel of the compression cap is received in the space between the flanges of the cleat.

10. The covering system for a building substrate of claim 7, wherein the central channel of the compression cap is configured to accept the means for attaching the covering system to the building substrate.

11. A covering system for a roofing substrate, comprising:

at least two roof panels, wherein each of the roof panels comprises a top side and two opposite, gutter shaped joints, wherein the joints have two sidewalls formed at about 90 degrees to a base wall;

a cleat configured to accept adjacent joints of the at least two roof panels;

a compression cap configured to bridge the adjacent joints, the compression cap having:

a top surface and a bottom surface, at least two gaskets on the bottom surface which form a watertight seal with a portion of the base wall of each of the adjacent joints of the at least two roof panels, at least two grooves on the top surface configured to receive a sealant material, and a central channel;

at least one screw which secures the covering system to the roofing substrate by attaching the compression cap and the cleat to the roofing substrate; and a cover cap having a top side with an inner surface and sidewalls formed at about 90 degrees to the top side, wherein the top side of the cover cap is flush with the top sides of the at least two roof panels, wherein the central channel of the compression cap is configured to accept the at least one screw, and the sealant material placed in the at least two grooves on the compression cap secures the cover cap and provides a watertight seal between the inner surface of the cover cap and the top surface of the compression cap.

12. The covering system for a roofing substrate of claim 11, wherein the sidewalls of each joint are formed at about 90 degrees to the top side of the at least two roof panels so that the base wall of the joint and the top side of the roof panel are on parallel planes.

13. The covering system for a roofing substrate of claim 11, wherein the cover cap conceals the compression cap and the at least one screw.

14. The covering system for a roofing substrate of claim 11, wherein the cleat comprises two upright flanges formed at about 90 degrees to a base of the cleat, wherein the central channel of the compression cap is received in the space between said flanges.

15. The covering system for a roofing substrate of claim 11, wherein the cleat is sized to allow lateral movement of the adjacent joints of the at least two panels within the cleat.

16. The covering system for a roofing substrate of claim 11, further comprising at least two insulation sheets, wherein each insulation sheet is placed between the roofing substrate and one of the at least two roof panels.

17. The covering system for a roofing substrate of claim 11, wherein the at least two roof panels are composed of sheet metal.

18. A covering system for a building substrate, comprising:

at least two panels, wherein each of the panels comprises a top side and two opposite, gutter shaped joints, wherein the joints have two sidewalls formed at about 90 degrees to a base wall;

a joint linking system which connects the at least two panels at adjacent joints; and means for attaching the covering system to the building substrate along the joint linking system, wherein the joint linking system provides a weather-tight seal on the building substrate, wherein the joint linking system is sized to allow lateral movement of the adjacent joints of the at least two panels, wherein the joint linking system lies flush with the top sides of the at least two panels.

19. The covering system of claim 18, wherein the joint linking system comprises:

a cleat configured to accept the adjacent joints of the at least two panels;

a compression cap configured to bridge the adjacent joints; and a cover cap having a top side, wherein the top side of the cover cap is flush with the top sides of the at least two panels, wherein the cover cap conceals the compression cap and the means for attaching the covering system to the building substrate.

20. The covering system of claim 19, wherein the means for attaching the covering system to the building substrate includes at least one screw which secures the compression cap and the cleat to the building substrate.

* * * * *